US009939220B2

(12) United States Patent
Speller

(10) Patent No.: US 9,939,220 B2
(45) Date of Patent: Apr. 10, 2018

(54) MAGAZINE AND BARREL BLOCK

(71) Applicant: Blok Safety Systems, LLC., Charlotte, NC (US)

(72) Inventor: Jason Patrick Speller, Charlotte, NC (US)

( * ) Notice: Subject to any disclaimer, the term of this patent is extended or adjusted under 35 U.S.C. 154(b) by 0 days.

(21) Appl. No.: 15/378,209

(22) Filed: Dec. 14, 2016

(65) Prior Publication Data

US 2017/0167815 A1 Jun. 15, 2017

Related U.S. Application Data

(60) Provisional application No. 62/266,928, filed on Dec. 14, 2015.

(51) Int. Cl.
*F41A 17/44* (2006.01)

(52) U.S. Cl.
CPC ..... *F41A 17/44* (2013.01)

(58) Field of Classification Search
CPC ..... F41A 17/00; F41A 17/44; F42B 8/08
USPC ..... 42/70.01, 70.11
See application file for complete search history.

(56) References Cited

U.S. PATENT DOCUMENTS 3,137,957 A * 6/1964 Ingalls ..... F41A 17/44 42/70.11
3,708,901 A * 1/1973 Wolter ..... F41A 17/44 42/70.11
3,710,490 A * 1/1973 Cornett ..... F41A 17/44 42/70.11
5,062,233 A * 11/1991 Brown ..... F41A 17/44 42/70.11
5,097,613 A * 3/1992 Miller ..... F41A 17/44 42/1.05
6,250,008 B1 * 6/2001 Silver ..... F41A 17/44 42/70.01
6,393,750 B1 * 5/2002 Rossini ..... F41A 17/02 42/70.11
D482,424 S 11/2003 Barber
6,796,072 B2 * 9/2004 Barber ..... F41A 17/44 42/70.11
6,862,831 B1 * 3/2005 Canaday ..... F41A 17/44 42/66
6,871,438 B2 * 3/2005 Lawless ..... F41A 33/00 42/70.01
D701,282 S * 3/2014 Ferguson, II ..... D22/108
9,310,149 B2 * 4/2016 Masters ..... F41A 17/44
(Continued)

OTHER PUBLICATIONS

Ammo-Safe; www.ammosafe.com.
(Continued)

*Primary Examiner* — Derrick R Morgan
(74) *Attorney, Agent, or Firm* — Bennet K. Langlotz; Langlotz Patent & Trademark Works, Inc.

(57) ABSTRACT

A firearm safety device having a barrel safety device embodiment for use with a firearm that has a chamber, ejection port and barrel. The barrel safety device having a stem adapted to enter the barrel of the firearm. The barrel safety device having a chamber plug adapted to enter and fit into the chamber of the firearm. The barrel safety device having a transition section between the stem and the chamber plug. Where the transition section is flexible under pressure to allow for installation of the chamber plug in the chamber through the ejection port.

19 Claims, 11 Drawing Sheets

(56) References Cited

U.S. PATENT DOCUMENTS

| | | | | |
|---|---|---|---|---|
| 2002/0189148 | A1* | 12/2002 | Hanson | F41A 17/44 42/70.11 |
| 2003/0172572 | A1* | 9/2003 | Clark | F41A 17/44 42/70.11 |
| 2003/0221351 | A1* | 12/2003 | Barber | F41A 17/44 42/70.11 |
| 2004/0055199 | A1* | 3/2004 | Chudwin | F41A 17/00 42/70.11 |
| 2004/0200113 | A1* | 10/2004 | Lawless | F41A 33/00 42/70.08 |
| 2006/0288625 | A1* | 12/2006 | Williams | F41A 17/54 42/70.11 |
| 2009/0071054 | A1* | 3/2009 | Rush | F41A 17/44 42/70.01 |
| 2011/0173860 | A1* | 7/2011 | Arendt | F41A 17/44 42/70.11 |
| 2012/0214136 | A1* | 8/2012 | Stone | F41A 17/44 434/16 |
| 2015/0168090 | A1* | 6/2015 | Bitsack | F41A 17/44 42/70.01 |
| 2015/0247690 | A1* | 9/2015 | Greenwood | F41A 3/72 89/1.4 |
| 2016/0076843 | A1* | 3/2016 | Masters | F41A 17/44 42/1.01 |
| 2016/0245610 | A1* | 8/2016 | Schulz | F41A 33/00 |
| 2017/0138687 | A1* | 5/2017 | Aziz | F41A 17/44 |

OTHER PUBLICATIONS

Mission First Tactical; http://www.lapolicegear.com/mft-sstix-barrel-plug.html.

Mako Safety Barrel; https://www.midwayusa.com/product/472547/mako-safety-rod-barrel-block-pistol-9mm-luger-polymer-orange.

Tap Rack Trainer; https://holsterops.com/products/tap-rack-training-aid-trt.

Aammosafe, Inc., "Ammo-Safe(TM)," http://www.ammosafe.com, (c) 2012-2017, Accessed Nov. 10, 2017.

Blade-Tech Industries, "Training Barrel," http://shop.blade-tech.com/training-barrel-c-81_123.html, (c) 2017, Accessed Nov. 10, 2017.

Train Safe(R), "Train Safe(R)," http://www.trainsafe.us, (c) 2017, Accessed Nov. 10, 2017.

La Police Gear, Inc., "Mission First Tactical Safe-T-Stix Barrel Plugs," http://www.lapolicegear.com/mft-sstix-barrel-plug.html, (c) 2001-2016, Accessed Nov. 10, 2017.

Midwayusa, Inc., "Mako Safety Rod Barrel Block Pistol 9mm Luger Polymer Orange," https://www.midwayusa.com/product/472547/mako-safety-rod-barrel-block-pistol-9mm-luger-polymer-orange, (c) 2017, Accessed Nov. 10, 2017.

Holsterops, "Tap Rack Training Aid (TRT)," https://holsterops.com/products/tap-rack-training-aid-trt, (c) 2017, Accessed Nov. 10, 2017.

* cited by examiner

MAGAZINE AND BARREL BLOCK

CROSS-REFERENCE TO RELATED APPLICATION

This application claims the benefit of and incorporates by reference U.S. Provisional Application No. 62/266,928, filed Dec. 14, 2015.

BACKGROUND OF THE INVENTION

The present invention generally relates to firearm safety. More specifically, the present invention relates to devices that prevent chambering of a firearm projectile, while indicating a firearm is safe to handle.

Firearm training is restrictive for students and instructors when using current methods and safety devices to make a firearm safe from firing a projectile during training. Most current safety device products on the market require the firearm to be disassembled in some manner for the product to be used with the firearm. Other products have flexible tips that cannot be used for clearance training purposes. The available safety device products also do not disengage slide stop levers or bolt assembly catches on firearms. The problem with the available safety devices is that they prohibit one or more of the mechanical functions of the firearm that are required to properly train with a firearm.

It is an object of the present invention to provide an improved safety device for firearm training that allows mechanical functions of the firearm without the danger of a projectile being loaded into the firearm.

SUMMARY OF THE INVENTION

The present invention provides a firearm safety device having a barrel safety device embodiment for use with a firearm having a chamber, ejection port and barrel. The barrel safety device having a stem adapted to enter the barrel of the firearm. The barrel safety device having a chamber plug adapted to enter and fit into the chamber of the firearm. The barrel safety device having a transition section between the stem and the chamber plug. Where, the transition section is flexible under pressure to allow for installation of the chamber plug in the chamber through the ejection port.

DESCRIPTION OF THE CURRENT EMBODIMENT

The present invention includes embodiments of a firearm safety device for pistols, rifles and shotguns that protect against loading of a projectile. The firearm safety device is used to render a firearm safe and maintain full functionality of the firearm. Embodiments of the firearm safety device allow for a firearm to be used as training aid, while retaining mechanical functionality of the firearm during training. The mechanical functionality includes manipulating the action of the firearm, which includes moving the bolt or slide of the firearm. The firearm safety device reduces the time and number of steps required to render the firearm safe. The firearm safety device does not require any firearm disassembly, thereby making its use convenient, while also preventing unnecessary exposure to lubricants and lead particulate.

Figure 1:
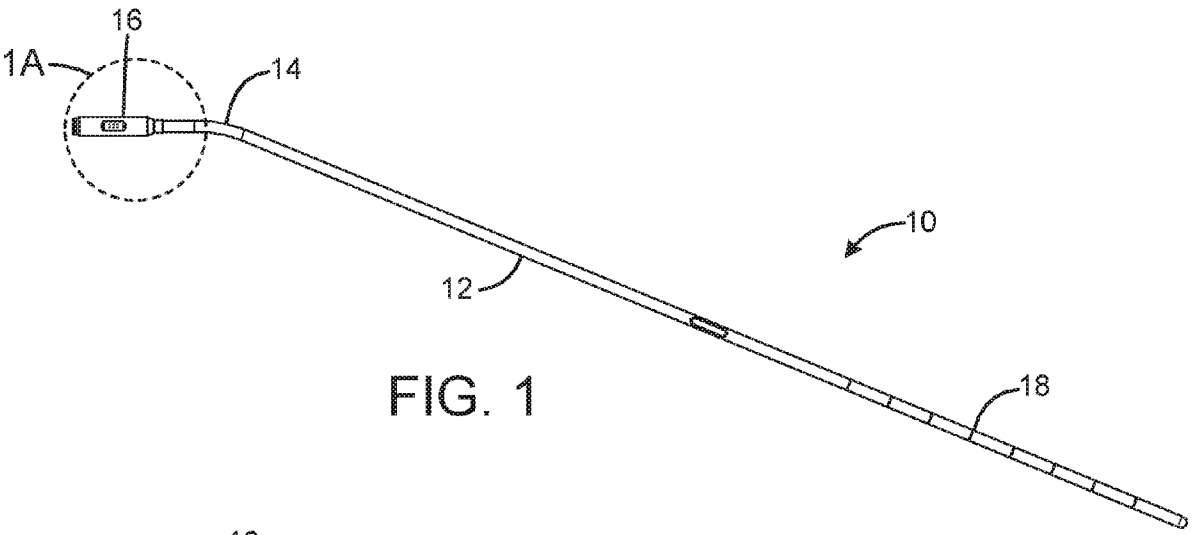
FIG. 1 is a side view of a barrel safety device according to the present invention.
Figure 2:
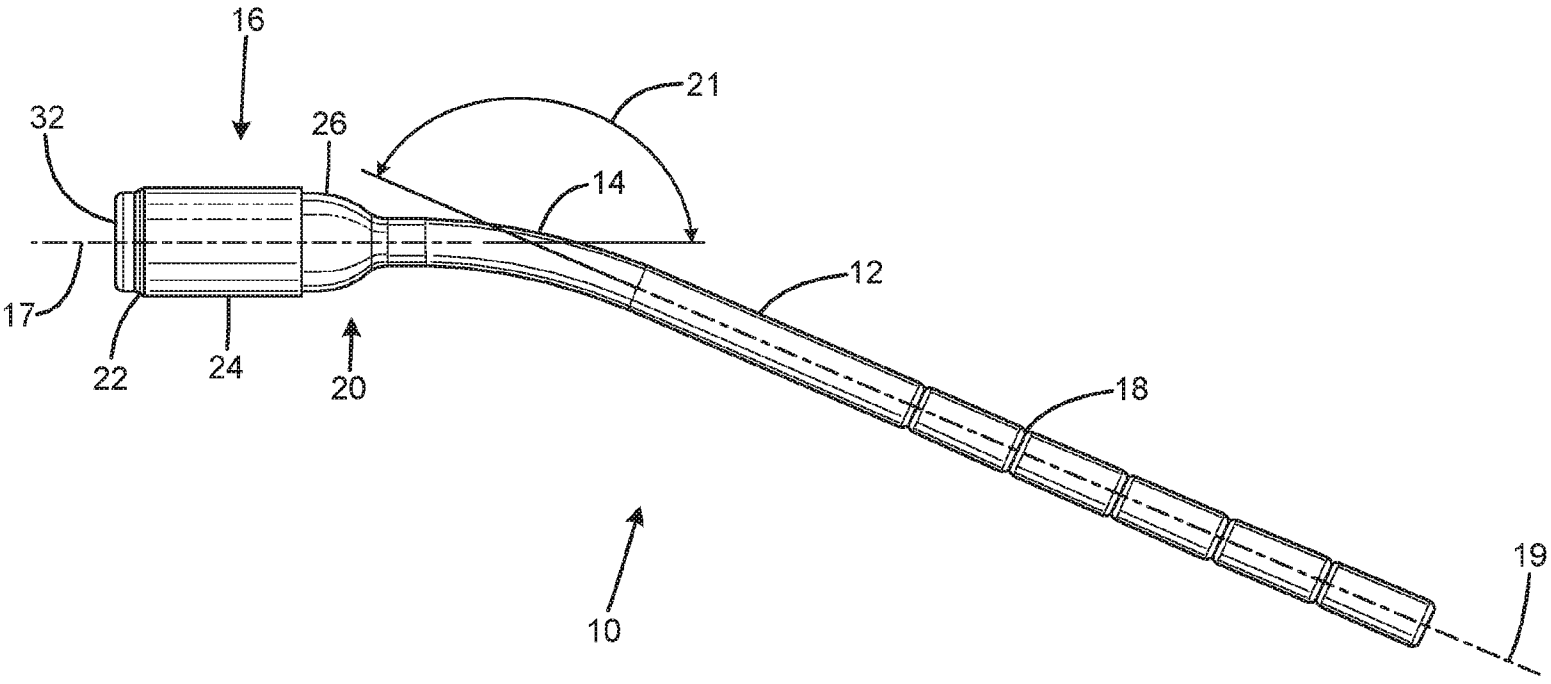
FIG. 2 is a side view of a barrel safety device according to the present invention.

The first embodiment is a barrel safety device for a barrel of a firearm, as shown in FIGS. 1-2. The barrel safety device 10 is made up of three portions that include a stem 12, transition section 14 and chamber plug 16. The stem 12 is at a first end and the chamber plug 16 is at a second end of the barrel safety device 10. The transition section 14 connects the stem 12 and chamber plug 16 together. The stem 12 is of a dimensional size to fit into the barrel of a firearm beyond the chamber of the firearm. The stem 12 may be made out of a flexible material. The shape of the stem 12 is shown as round shaft with a slightly smaller diameter than the caliber of the barrel. It is envisioned that the stem 12 can be a shaft with other shapes than the round shaft. The stem 12 includes incremental grooves 18 to facilitate for shorting the length of the stem 12 to fit varied barrel lengths. The grooves 18 provide cutting points along the stem 12 and it is envisioned the grooves 18 be at one half inch intervals.

Figure 1A:
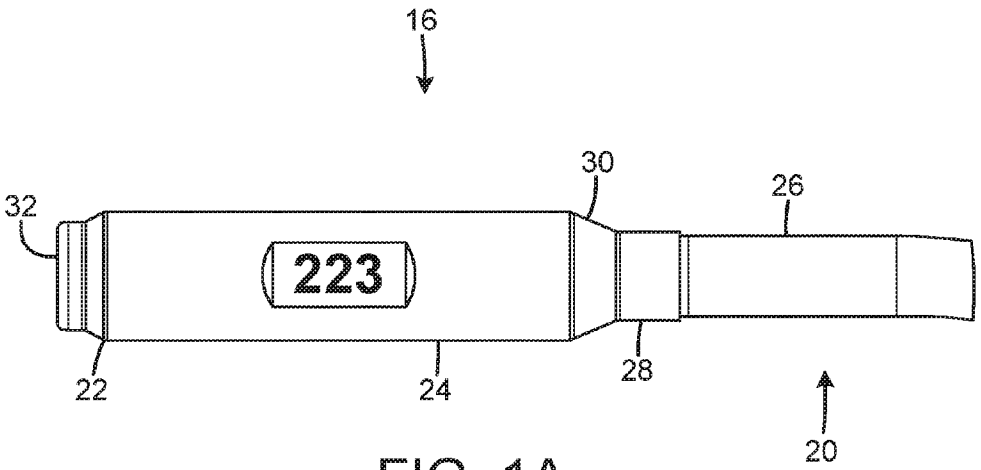
FIG. 1A is a close up view of a chamber plug of the barrel safety device shown in FIG. 1 according to the present invention.

The chamber plug 16 simulates the shape and size of a cartridge used with a firearm, so the chamber plug 16 may enter the chamber of the firearm. While the chamber plug 16 is shown as having essentially the same contours as a cartridge, it may also have a skeletal form with overall similar external dimensions but with perforations or voids to conserve materials or weight. The important aspect is that the chamber plug 16 fits closely but not tightly in the chamber. FIG. 1A shows a chamber plug 16 for a rifle round and FIG. 2 shows a chamber plug 16 for a pistol round. The chamber plug 16 includes a front end 20, rear end 22 and middle 24. The front end 20 of the chamber plug 16 is connected to the transition section 14. The front end 20 simulates the projectile, neck of a cartridge case and shoulder of a cartridge case. The front end 20 includes a projectile section 26, neck section 28 and shoulder section 30, as shown in FIG. 2.

In FIG. 1, the front end 20 simulates the projectile only with the projectile section 26, as most pistol cartridges do not have a neck or shoulder as part of the cartridge case. The projectile section 26, neck section 28 and shoulder section 30 are all sized in the range of a normal cartridge used with the firearm. The middle 24 of the chamber plug 16 simulates the body of a cartridge case. The rear end 22 of the chamber plug 16 simulates the head of the cartridge case without the rim. The rear end 22 is beveled from larger diameter at the middle 24 outward to a smaller diameter. The beveled shape of the rear end 22 mimics the extractor groove of a cartridge case without the rim and allows the extractor of the firearm to engage without pulling at the chamber plug 16, when the extractor retracts. This ensures that the barrel safety device 10 remains in the firearm even when the slide or bolt is cycled during use to simulated the action of the firearm with a live cartridge. The chamber plug 16 includes a rounded end cap 32 in the normal location of a rim of a cartridge case.

The transition section 14 of the barrel safety device 10 is an articulated portion, which is flexible in nature when force is applied, yet resilient such that it returns to its normal position when the force is released. The transition section 14 is shown to be shorter in length than the stem. The material of the transition section 14 allows the transition section to be flexed from its normal position. As shown in FIGS. 1-2, the transition section 14 is shown in its normal position as a slightly curved transition from the stem 12 to the chamber plug 16. Under force, the transition section 14 can be flexed into a straight transition from the stem 12 to the chamber plug 16. Whereby, the transition section 14 generates a force or torque on the other portions of the barrel safety device 10 connected to the transition section 14, when installed and bent into a straighter shape. This force serves to prevent the barrel safety device 10 from inadvertently being removed from the firearm. A plug center axis 17 of the chamber plug 16 and a stem center axis 19 of the stem 12 are inclined to each other by an angle 21, as shown in FIG. 2. This angle can be between fifteen and forty-five degrees. The preferred angle is twenty-two and one half (22.5) degrees in the preferred embodiment. The angle may be a large as forty-five degrees, above which there may be permanent deformation of the barrel safety device 10 and excessive extraction force would be required to install and remove. The angle may be as small as fifteen degrees, below which there may be inadequate resistance to prevent accidental removal of the barrel safety device 10, and present challenges to removing the chamber plug 16 from the chamber and ejection port without the use of tools. When the barrel safety device 10 is installed the plug center axis 17 and the stem center axis 19 are coincident to each other. When the barrel safety device is removed, the transition section 14 will return to the original curved shape without deformation. The range of the radius of the curve section is between two and three inches, with the preferred radius being 2.389 inches. It is also envisioned that the normal position of the transition section 14 can be straight and the transition section 14 can be forced into a curved transition, as opposed to be curve and forced into a straight configuration.

Figure 3:
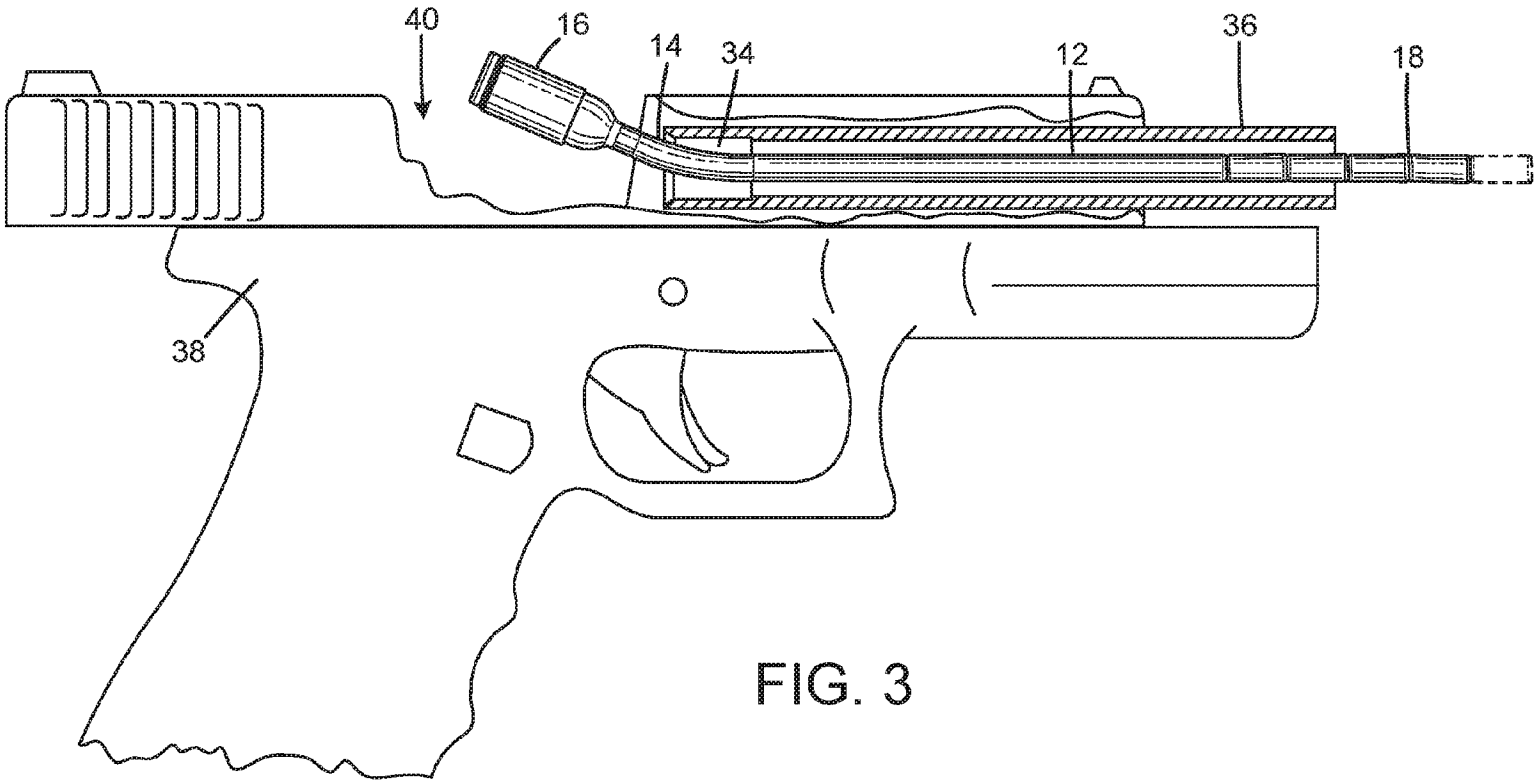
FIG. 3 is side view of barrel safety device during installation in a firearm according to the present invention.
Figure 4:
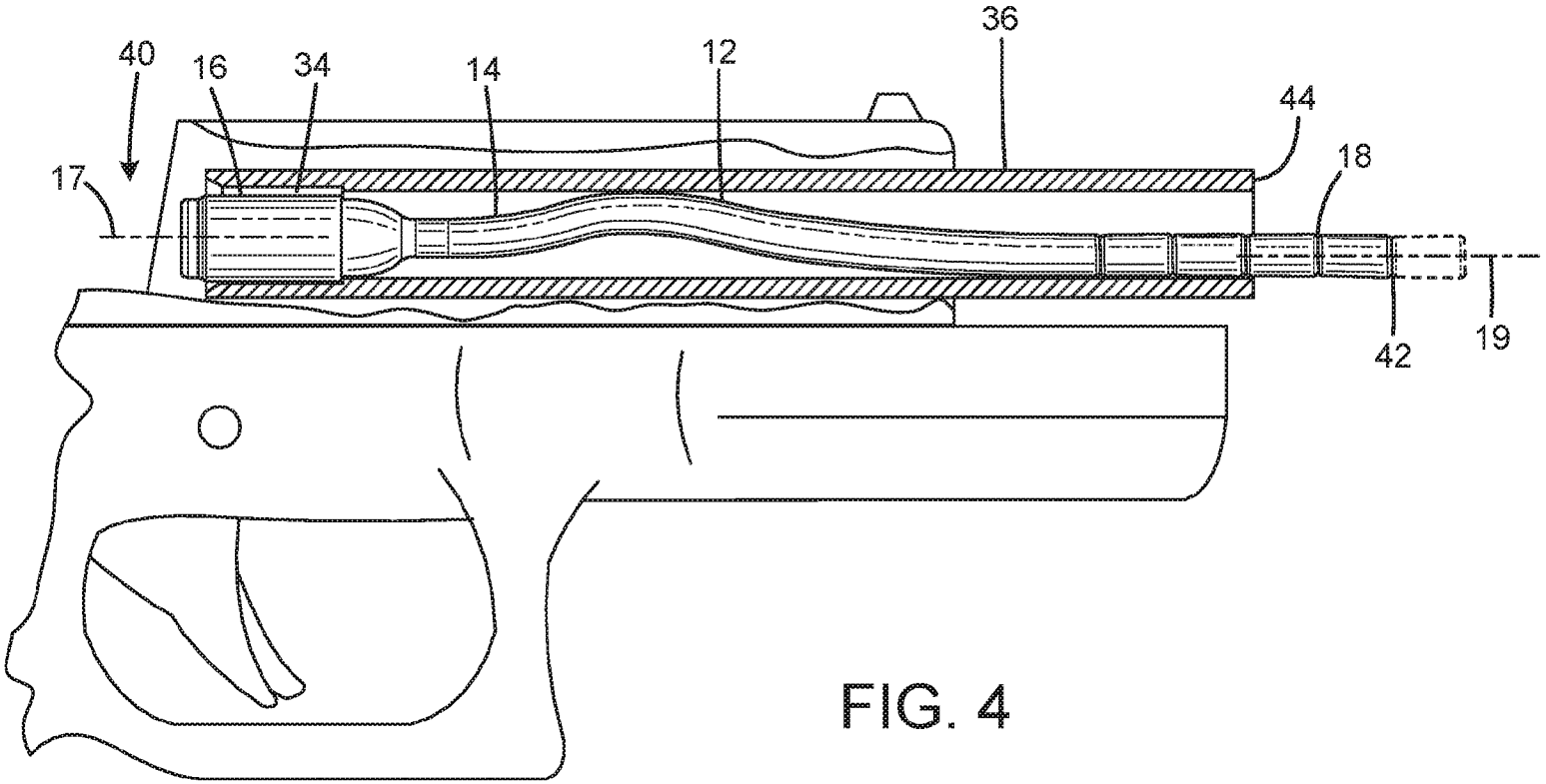
FIG. 4 is side view of barrel safety device installed in a firearm according to the present invention.
Figure 5:
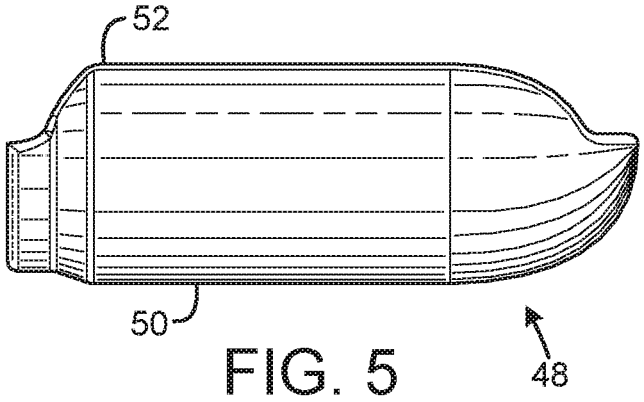
FIG. 5 is side view of magazine safety device according to the present invention.

FIGS. 3-4 show the installation of the barrel safety device 10 of FIGS. 1-2. The stem 12 is inserted into the chamber 34 of a barrel 36 of a firearm 38 through an ejection port 40 of the firearm 38. FIG. 3 shows the position of the transition section 14 as the transition section 14 enters the chamber 34. As the transition section 14 enters the chamber 34, the transition section 14 straightens from its normal curved shape due to the force of insertion into the chamber 34. The normal curved shape of the transition section 14 aids in the insertion and removal of the chamber plug 16 into and out of the ejection port 40 of the firearm 38. FIG. 4 shows the chamber plug 16 after insertion into the chamber 34. The chamber plug 16 fits snuggly into the chamber 34 as a regular cartridge would fit into the chamber 34. FIG. 4 also shows plug center axis 17 and stem center axis 19 coincident to each other. After insertion of the barrel safety device 10, a tip 42 of the stem 12 extends out of the muzzle 44 of the barrel 36 of the firearm 38, as shown in FIG. 4. The stem 12 is trimmed at one the grooves 18 so that the stem 12 does not extend out too far, where the removed portion is shown by the dotted lines in FIG. 4. To remove the barrel safety device 10, the tip 42 of the stem 12 is pushed inward into the muzzle 44. Pushing the tip 42 inward causes the chamber plug 16 to move out the chamber 34. As the chamber plug 16 moves out of the chamber 34, the chamber plug 16 curves out of the ejection port 40. The reason the chamber plug 16 curves out of the ejection port 40 is that the transition section 14 is returning to the normal curved shape of the transition section 14. The return to the normal curved shape of the transition section 14 makes it easier to remove the barrel safety device 10 from the firearm 38.

The barrel safety device 10 creates an obstruction in the barrel 36 and chamber 34 to prevent a cartridge from being chambered into the firearm 38. The stem 12 extending out from the muzzle 44 serves as a visual indicator that the firearm 38 has the barrel safety device 10 installed. The tip 42 of the stem 12 extending from the muzzle 44, also acts as a holster clearance-training indicator. It is envisioned that the stem 12 can be stiff enough to resist holstering in closed end holsters, so that the stem 12 does not flex during holstering. The use of open end holsters can provide a benefit where an instructor can visually verify that a student's firearm has the barrel safety device 10 installed by seeing the tip of the stem 12 protruding from the holster. The tip of the stem 12 also aids user in establishing the correct draw height from the holster. The slide or bolt assembly with extractor of the firearm maintains mechanical functionality and unrestricted movement with the barrel safety device 10 installed.

Figure 6:
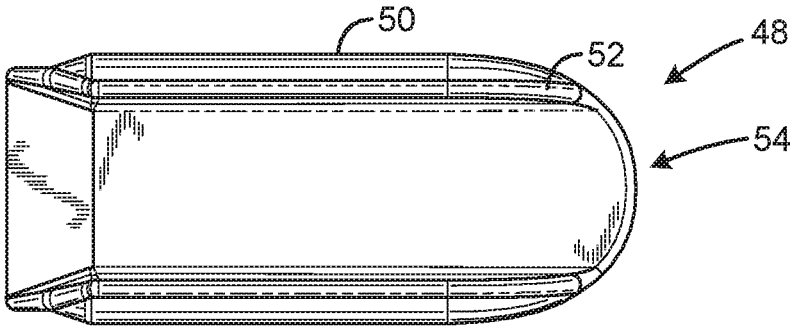
FIG. 6 is top view of magazine safety device according to the present invention.
Figure 7:
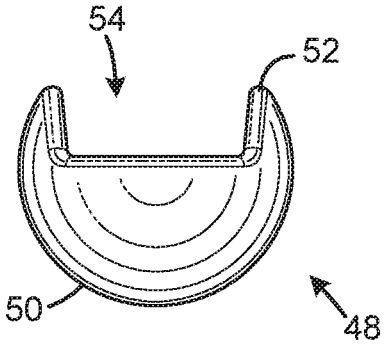
FIG. 7 is front view of magazine safety device according to the present invention.
Figure 8:
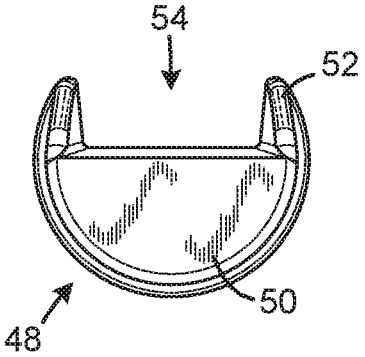
FIG. 8 is rear view of magazine safety device according to the present invention.
Figure 9:
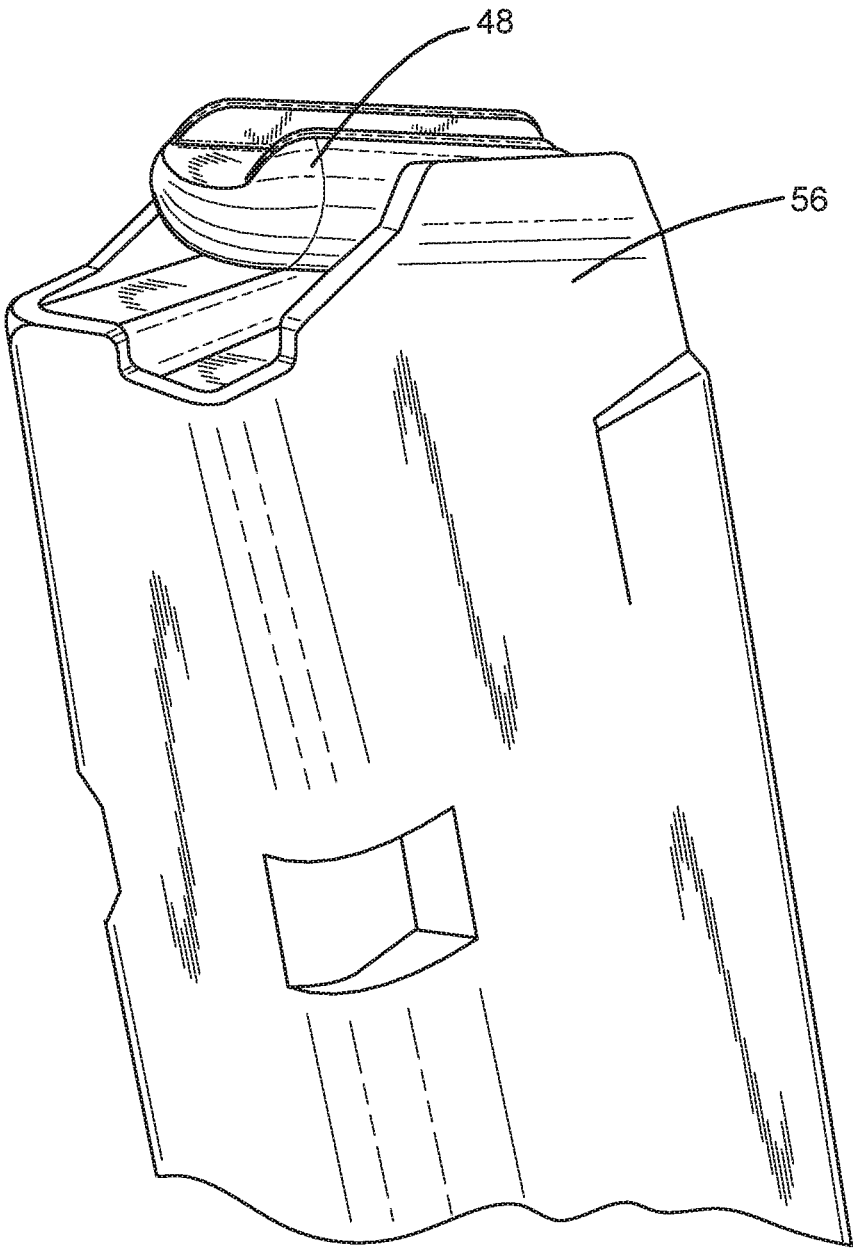
FIG. 9 is front perspective view of magazine safety device installed in a magazine according to the present invention.
Figure 10:
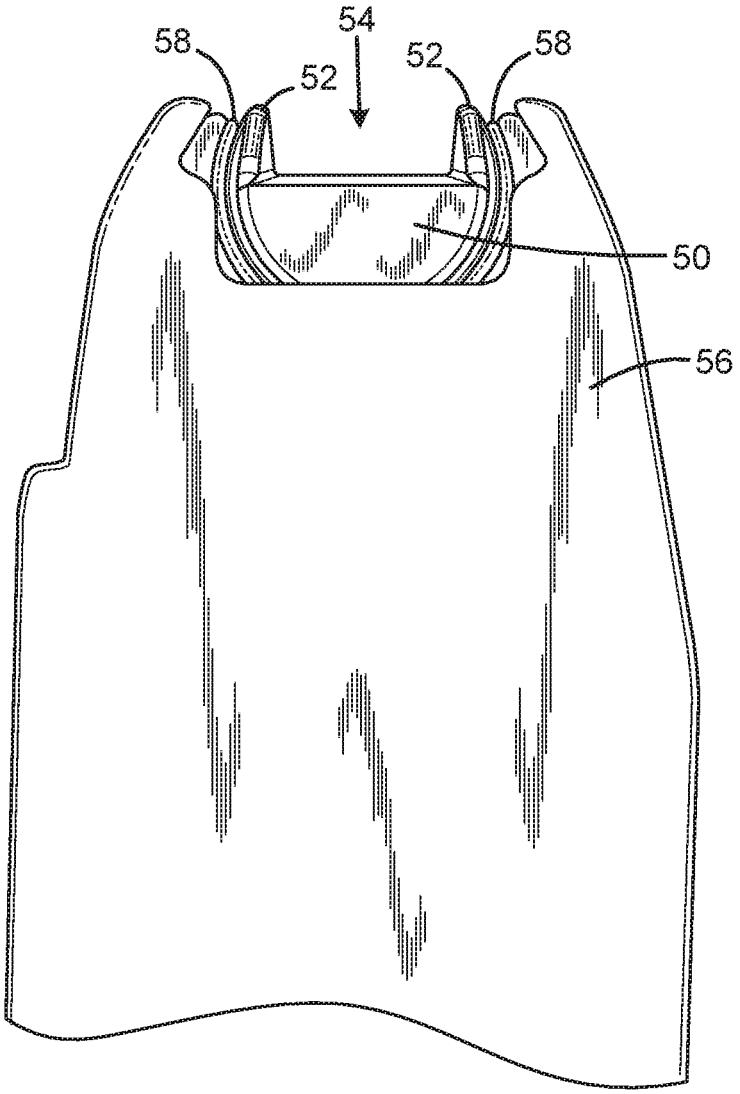
FIG. 10 is rear view of magazine safety device installed in a magazine according to the present invention.
Figure 11:
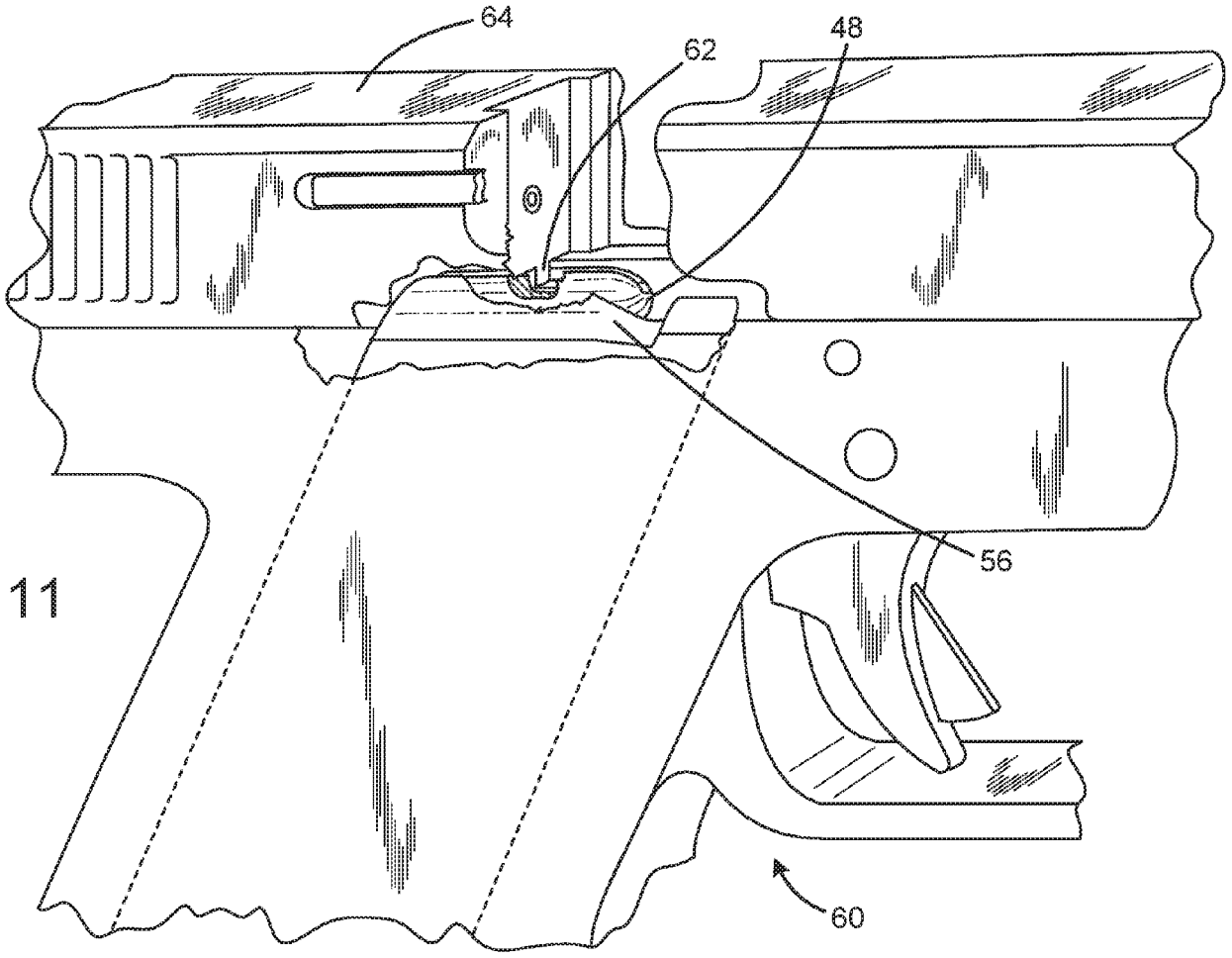
FIG. 11 is side view of magazine safety device installed in a magazine that is installed in a firearm according to the present invention.

The second embodiment is a magazine safety device 48 for a magazine of a firearm, as shown in FIGS. 6-8. The magazine safety device 48 includes a cartridge body 50 with lip walls 52. The outside shape of the cartridge body simulates a portion of a cartridge. The lip walls 52 extend upward from a flat top of the cartridge body 50 to form a bolt channel 54 between the lip walls 52 and the top of the cartridge body 50. Together, the cartridge body 50 and lip walls 52 simulate a cartridge, as the lip walls 52 continue the cartridge shape from the cartridge body 50. The lip walls 52 are used to extend the shape of the cartridge shape. FIGS. 9-10 show the magazine safety device 48 installed in a magazine 56 of a firearm. FIG. 9 shows a front perspective view and FIG. 10 shows a rear view. The magazine safety device 48 is pressed into the magazine 56 in the same manner as a regular cartridge would be loaded into the magazine 56. The outside shape of the cartridge body 50 presses down on a follower of the magazine 56 or a cartridge loaded in the magazine 56. In either case, the lip walls 52 due to the cartridge shape engage the lips 58 of the magazine 56 and retain the magazine safety device 48, as shown in FIG. 10. FIG. 11 shows the magazine 56 with the magazine safety device 10 installed in a firearm 60. The slide of a semi auto pistol acts as the bolt in most semi auto pistols. FIG. 11 shows a bolt portion 62 of slide 64 of a pistol moving past the magazine safety device 48 without engaging the magazine safety device 48. The bolt channel 54 of the magazine safety device 48 allows the bolt portion 62 of slide 64 or a bolt to pass freely leaving the magazine safety device 48 installed in the magazine 56. The magazine safety device 48 simulating a cartridge installed in the magazine 56 also prevents the follower of the magazine 56 from engaging a slide stop lever or bolt catch on a firearm. This allows the firearm's slide or bolt assembly to be mechanically actuated forward and rearward without being locked into the open position or chambering a cartridge. An advantage to the magazine safety device 48 is that it allows a magazine with cartridges below the magazine safety device to be used. Use of a magazine loaded with cartridges is considered beneficial because it gives a more accurate weight and balance for training.

The barrel safety device 10 and magazine safety device 48 work in conjunction with each other to prevent a firearm is from chambering and/or firing a live cartridge, while maintaining the full mechanical functionality of the firearm. Where a user would install the barrel safety device 10 into the chamber of a firearm and load a magazine with the magazine safety device 48 installed above a cartridge or follower. While the barrel safety device 10 and magazine safety device 48 are designed to be used together, they can be used independently of each other to achieve similar functions of the firearm. If the barrel safety device 10 is used alone with an empty magazine inserted into the firearm, the firearm is incapable of chambering a cartridge, however the slide or bolt assembly will lock to the rear when actuated, thus requiring the user to manually release the slide. If the magazine is removed, then the movement of the slide or bolt assembly is not impaired. If just the magazine safety 48 device is used alone, the movement of the slide or bolt assemble is not impaired, however the chamber of the firearm is open and a live cartridge could be introduced into the chamber causing a negligent discharge of the firearm.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

We claim:

1. A firearm safety device comprising:

a plug portion having an exterior profile adapted to be closely received and retained in the chamber of a firearm barrel, said plug having a forward end, a rear free end and a plug axis defined between said forward end and said rear free ends;

an elongated stem extending from said forward end of said plug and having a free end opposite from said plug, said free end having a stem axis along said free end;

said stem having an articulated portion between said plug and said free end of said stem, such that said plug axis and stem axis are angularly offset from each other; and wherein said articulated portion is a resilient material such that said articulated portion shifts the plug portion laterally out of a firearm ejection port upon removal of the device from the firearm to facilitate removal of the device from the firearm.

2. The firearm safety device of claim 1, wherein said articulated portion is an arcuate segment.

3. The firearm safety device of claim 1, wherein said articulated portion is adjacent to said plug.

4. The firearm safety device of claim 1, wherein said plug axis and said stem axis are offset by at least fifteen degrees.

5. The firearm safety device of claim 1, wherein said plug axis and said stem axis are offset by at most forty-five degrees.

6. The firearm safety device of claim 1, wherein said free end of said stem is longer than said articulated portion.

7. The firearm safety device of claim 1, wherein said free end of said stem includes a plurality of grooves at intervals along a length of said free end of said stem to facilitate shortening said stem to a selected length.

8. The firearm safety device of claim 1, wherein said articulated portion is of a resilient material selected to enable said firearm safety device to be straightened to a straight condition in which said plug axis and said stem axis are coincident, and to return to an original shape without permanent deformation.

9. The firearm safety device of claim 1, wherein said plug is of a cartridge shape having a projectile section to simulate a projectile and having a body section to simulate a body of said cartridge shape.

10. The firearm safety device of claim 9, further including a shoulder shape and a neck shape between said projectile section and said body section.

11. The firearm safety device of claim 1, wherein said plug includes a rear end, said rear end shaped to simulate a head of a cartridge without a rim that is adapted to allow an extractor of the firearm to function without removing said plug from the chamber.

12. A barrel safety device, for use with a firearm having a chamber, ejection port and barrel, comprising:

a stem adapted to enter the barrel of the firearm;

a chamber plug of a shape adapted to enter and fit into the chamber of the firearm such that said chamber plug is retained in the chamber; and a transition section between said stem and said chamber plug, said transition section flexible under force to allow for installation of the chamber plug in the chamber through the ejection port; and wherein said transition section is a resilient material such that said transition section shifts the plug laterally out of the ejection port upon removal of the device from the firearm to facilitate removal of the device from the firearm.

13. The barrel safety device of claim 12, wherein said transition section is curved as a normal condition and is straight when forced into the firearm.

14. The barrel safety device of claim 13, wherein said chamber plug is of a cartridge shape having a projectile section to simulate a projectile and having a body section to simulate a body of said cartridge shape.

15. The barrel safety device of claim 14, further including a shoulder shape and a neck shape between said projectile section and said body section.

16. The barrel safety device of claim 12, wherein said chamber plug includes a rear end, said rear end shaped to simulate a head of a cartridge without a rim that is adapted to allow an extractor of the firearm to function without removing said plug from the chamber.

17. A method of preventing loading of a cartridge in a chamber and barrel of a firearm using a barrel safety device having a stem, transition section and chamber plug, wherein said transition section is a resilient material such that said transition section shifts the chamber plug laterally out of a firearm ejection port upon removal of the device from the firearm to facilitate removal of the device from the firearm, comprising the steps:

inserting the stem into an ejection port and then into the chamber and barrel of the firearm;

inserting the transition section connected to the stem into the ejection port the chamber and barrel of the firearm so that the transition section follows the stem into the barrel;

applying force to the transition section so that the transition section flexes during installation of the barrel safety device to allow further installation of the chamber plug; and inserting the chamber plug into the chamber.

18. The method of claim 17, further including trimming the stem to reduce the length of the stem which protrudes from the barrel of the firearm.

19. The method of claim 17, wherein the chamber plug includes a rear end, the rear end shaped to simulate a head of a cartridge without a rim to allow an extractor of the firearm to function without removing the chamber plug from the chamber and further including mechanically manipulating the action of the firearm without removing the barrel safety device; and wherein said plug is of cartridge shape having a projectile section to simulate a projectile and having a body section to simulate a body of said cartridge shape.

* * * * *